US006409052B1

(12) United States Patent
Barriac et al.

(10) Patent No.: US 6,409,052 B1
(45) Date of Patent: Jun. 25, 2002

(54) TRIGGER SPRAYER DISPENSING SYSTEM

(75) Inventors: Jacques J. Barriac, Lee's Summit, MO (US); Joseph Krestine, Leawood, KS (US); Steven L. Sweeton, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/072,897

(22) Filed: Feb. 12, 2002

Related U.S. Application Data

(62) Division of application No. 09/709,445, filed on Nov. 13, 2000.

(51) Int. Cl.[7] ..... B67D 5/40

(52) U.S. Cl. ..... 222/383.3; 222/382; 222/464.3; 222/530

(58) Field of Search ..... 222/383.3, 383.1, 222/382, 464.1, 464.3, 530, 527, 538, 556; 285/23, 24, 921, 242

(56) References Cited

U.S. PATENT DOCUMENTS

| | | | | |
|---|---|---|---|---|
| 1,798,708 A | | 3/1931 | Smith | |
| 1,869,869 A | | 8/1932 | Smith | |
| 1,875,992 A | | 9/1932 | Clifford | |
| 3,168,248 A | | 2/1965 | Winslow | |
| 3,901,449 A | | 8/1975 | Bochmann | |
| 4,621,770 A | | 11/1986 | Sayen | |
| 4,832,237 A | * | 5/1989 | Hurford, Jr. | 222/189.1 |
| 5,154,324 A | | 10/1992 | Stratford | |
| 5,469,993 A | | 11/1995 | Hauf et al. | |
| 5,553,750 A | | 9/1996 | Foster | |
| D380,148 S | | 6/1997 | Hauf et al. | |
| 5,651,908 A | | 7/1997 | Mansfield | |
| 5,988,456 A | * | 11/1999 | Laible | 222/464.1 |
| 6,050,459 A | * | 4/2000 | Johnson et al. | 222/382 |

* cited by examiner

*Primary Examiner*—Lesley D. Morris
*Assistant Examiner*—Stephanie L. Willatt
(74) *Attorney, Agent, or Firm*—Dykema Gossett PLLC

(57) ABSTRACT

The dispensing system for a remote operation includes a trigger sprayer assembly removably mounted to a container of liquid to be sprayed, the assembly being mounted within a cutout section provided at the upper end of the container as part of a through opening forming the carrying handle of the container. The trigger sprayer assembly has a flexible delivery tube which may be coiled and stored within a hollow gripper handle provided on the trigger sprayer, and may extend outwardly from the gripper handle to function as a resilient element for mounting the trigger sprayer in place. A one-piece adaptor is non-removably connected to a distal end of the delivery tube and connects to the container by mounting directly to an external dip tube of the container or by mounting in a closure cap of the container.

4 Claims, 4 Drawing Sheets

23
40
38
35
34
39
64
48
43
42
37
44
58
59
56
61
54
55
57
52
53
46
47
60
45
41
62
65
81
68
79
78
22
69
71
67
63
72
76
73
21
74
75
66

TRIGGER SPRAYER DISPENSING SYSTEM

CROSS-REFERENCED TO RELATED APPLICATION

This application is a divisional of application Ser. No. 09/709,445, filed Nov. 13, 2000.

BACKGROUND OF THE INVENTION

This invention relates generally to a trigger actuated dispensing system and, more particularly, to a remote trigger sprayer tethered to a container of liquid to be dispensed for remote operation.

Remote dispensing systems for spraying of especially pesticides, insecticides, plant and grass nutrients, and the like, for lawn and garden applications, have been available in many forms for a number of years. One such system disclosed in U.S. Pat. No. 5,553,750 includes a trigger sprayer having a cylindrical handle connected to a container closure and having flexible tubing stored in accordance with one embodiment within the container during periods of non-use and capable of being drawn from the container during a spraying operation. In another embodiment the tubing is coiled and stored within a receptacle located within the container during periods of the non-use. During the spraying operation, the trigger sprayer is removed from the closure and the tubing is uncoiled from its receptacle.

Storage of the coiled or uncoiled tubing within the container is, however, cumbersome and awkward, as the coil may stick or snag as it being pulled out of the liquid container. Besides, the trigger sprayer with its handle remains connected to the container closure for periods of non-use such as shipping and storage. This is cumbersome as additional shelf space and storage space is required rendering the dispensing package as inefficient and less desirable.

Another known remote sprayer is disclosed in U.S. Pat. No. 5,469,993 in which a trigger sprayer with its handle is stored within a recess provided in a side wall of the liquid container which recess is sized and shaped for receiving the sprayer handle. For retaining the handle in place, protrusions are formed as integral parts of the container and tabs are formed as integral parts of the sprayer to facilitate a resilient snap fit between the protrusions and the slots. The hollow tubing connectable to the container through the closure cap is coiled and stored within the hollow trigger sprayer handle, together with its container connector. When in use the handle is removed from the container recess and its connector is plugged into a spout mounted on the container closure for movement between open and closed positions.

The aforedescribed system is however not without its disadvantages. For example, the container and trigger handle must be specially molded to facilitate the removable mounting of the handle to the container. This is costly and uneconomical requiring special tools or blow molding equipment, adding to the cost of the dispensing package. And the plug-in connection between the tube connector and the spout could render the system inoperable, should the spout be accidentally pivoted to its closed position.

There is a need for improvement in the design and operation of the known remote trigger sprayers which would render the container easier to produce and of less complex construction while offering a more convenient and easier to use dispensing package to the consumer.

U.S. Pat. No. 6,050,459 discloses a rigid dip tube connector for a liquid spray dispenser which includes a cap body having a shipper cap hinged over its upper end and a connector attached to the flexible tubing to effect connection of a trigger sprayer to the container. The connector is of two-part construction and is coupled to the closure with the shipper cap open. The coupler between the connector and the closure is however so structured that it presents a relatively insecure coupling. And the two-part construction required for the connector renders it more difficult and more costly to produce.

There is a further need to improve upon such a connector which would be of simpler and less costly design yet highly effective in coupling a flexible tube to a rigid dip tube.

SUMMARY OF THE INVENTION

It is therefore an object of the present invention to provide an improved trigger sprayer dispensing system for connection to a liquid container to which the trigger sprayer and its hollow handle is removably mounted in a manner rendering it easier to mass produce and convenient to carry and use. The trigger is removably mounted in place in a convenient location for quick removal by the operator while requiring no complex molding of either the handle or the container for facilitating a simple mount and easy removal of the sprayer.

It is a further object to provide such a dispensing system wherein an adaptor of one-piece molded construction is provided which, together with a simplified container closure, is economical and easy to use yet highly effective for facilitating connection of the hollow coil to the closure which supports a rigid dip tube.

In carrying out the afore described general objectives, the dispensing system according to the invention includes a container of liquid product to be dispensed, the upper portion of which having an opening defining the carrying handle. The handle forming opening is enlarged for the reception of a remote trigger sprayer assembly of the type having a gripping handle. The assembly, which is removably attached to the container when not in use, has a flexible hollow delivery tube connectable to the interior of the container. Opposing side walls of the trigger sprayer have laterally outwardly extending protrusions, and the enlarged opening at the upper end of the container have recesses of complementary size and shape to that of the trigger sprayer protrusions for the snug reception of the sprayer assembly.

In accordance with one embodiment of the present invention, the delivery tube may be coiled about the exterior of the gripper handle of the trigger sprayer in its stored position.

Another embodiment of this invention provides that the delivery tube may be coiled and stored within the gripper handle of the trigger sprayer which is hollow, the hollow interior having a predetermined depth such that a portion of the stored coil extends outwardly of the interior of the gripper handle and resiliently bears against a confronting portion of the container at the container opening for resiliently mounting the trigger sprayer in place.

In accordance with another feature of the present invention, an adaptor is nonremovably connected to one end of the delivery tube, the adaptor being of one-piece molded plastic construction which is removably connected to the container directly or indirectly. The adaptor is nonremovably connected to the hollow delivery tube by the provision of a ratchet disc, which may be conical and hinged to a body portion of the adaptor. The disc has an opening which in a use position is coaxial with a through opening extending through the body. The disc opening is defined by a plurality of resilient tines defining one-way ratchet teeth engaging the delivery tube when it is inserted through the coaxial openings.

Further in accordance with the invention, the adaptor may have an internally threaded sleeve for threaded engagement with an external dip tube connected to the container. Otherwise the adaptor may have a hollow nipple coaxial with the body opening for engagement with a closure cap mounted on the container.

Another feature of this invention comprises an assembly for connecting a flexible hollow fluid delivery tube to a rigid dip tube for a liquid spray dispenser, the assembly comprising a container closure having a cylindrical side wall for engagement with the neck of a container, and an end wall having a central well for the reception of a flexible tube adaptor.

Further in accordance with the invention, the end wall defining the well includes a vent port, the adaptor when seated within the well defining together therewith a vent path to the atmosphere.

Other objects, advantages and novel features of the invention will become more apparently from the following detailed description of the invention when taken in conjunction with the accompanying drawings.

DETAILED DESCRIPTION OF THE INVENTION

Figure 2:
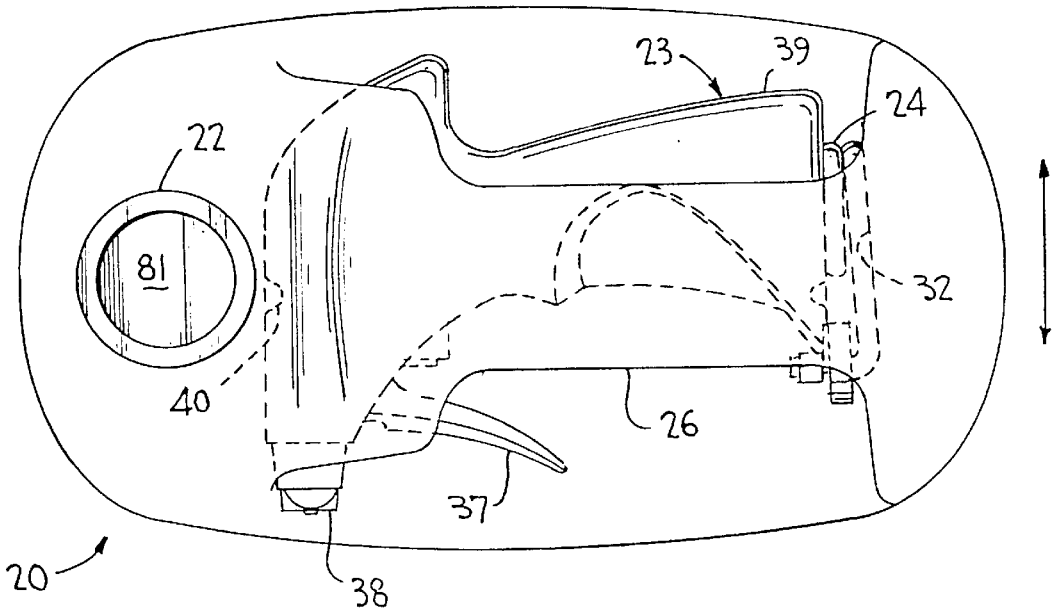
FIG. 2 is a top plan view of the system according to FIG. 1.
Figure 1:
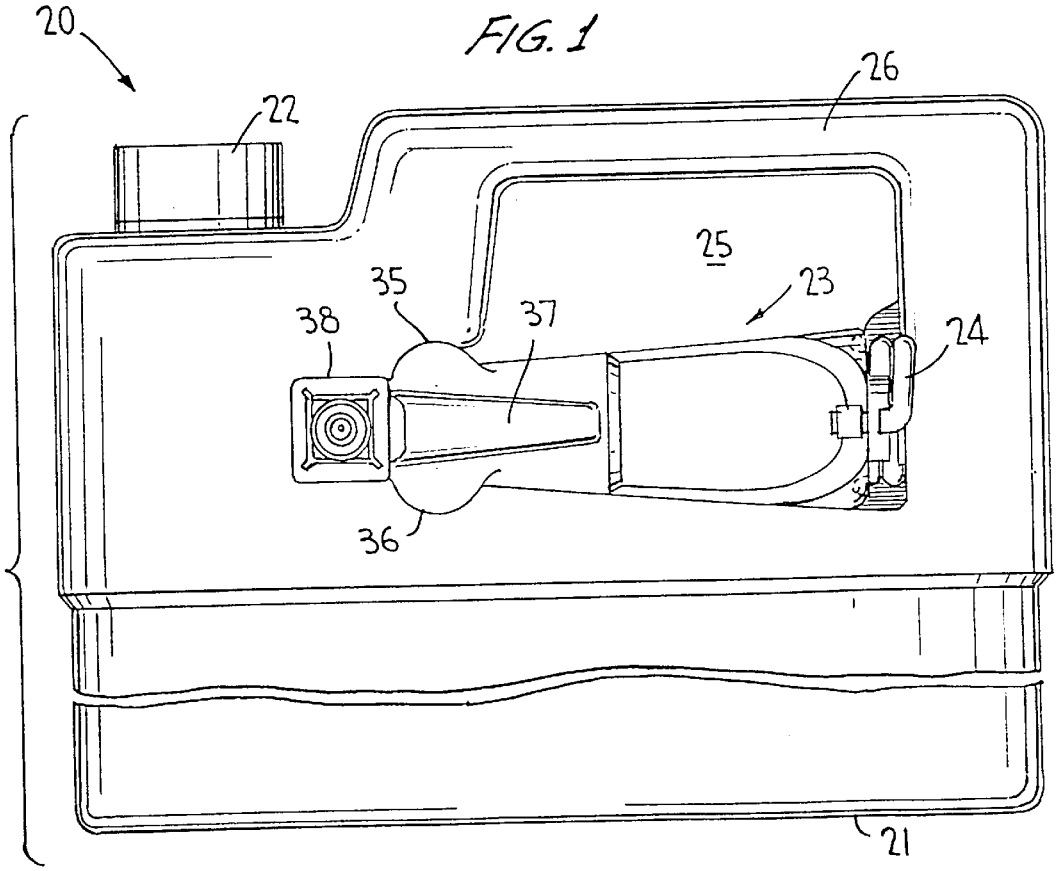
FIG. 1 is a side elevational view of the dispensing system of the invention which includes a container, a removably mounted trigger sprayer assembly and in accordance with one embodiment, a coiled delivery tube extending out of the assembly.

Turning now to the drawings wherein like reference characters refer to like and corresponding parts throughout the several views, a dispensing system is generally designated 20 as shown in FIGS. 1 and 2 in accordance with one embodiment of the invention. The dispensing system comprises a container 21 for containing a liquid to be dispensed such as for lawn or garden treatment, the container having a closure cap 22, and a trigger sprayer assembly 23 removably mounted to the container. The container may be of a high density polypropylene. And, assembly 23 has a hollow elongated flexible delivery tube 24 shown in its non-use position of storage and shipping in FIGS. 1 and 2.

Figure 3:
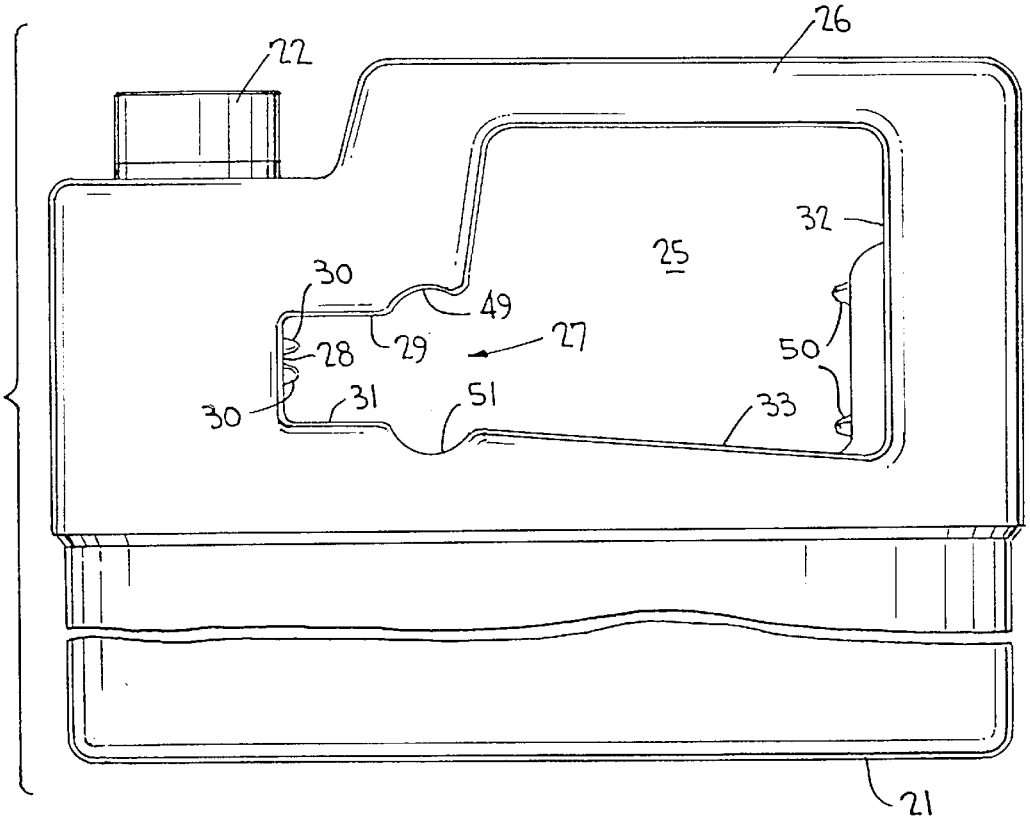
FIG. 3 is a view similar to FIG. 1 in which the trigger sprayer assembly is removed.

An upper portion of the container has a through transverse opening 25 which in part defines a conventional, integral, carrying handle 26 of the container. As shown in FIG. 3, opening 25 is enlarged to provide for the convenient mounting at the upper portion of the container of trigger sprayer assembly 23 shown mounted in place in FIGS. 1 and 2. The enlargement includes a cutout portion 27 defined by transverse walls 28, 29, 31. Cutout 27 opens laterally toward an upstanding wall 32 of the container which forms part of opening 25. Also, a lower sloping wall 33 which connects with wall 31 forms another part of opening 25.

Trigger sprayer assembly 23 has a sprayer shroud 34 (FIG. 4) formed with side protuberances 35, 36 (FIG. 1) as shown and described in more detail in application Ser. No. 09/660,476, filed Sep. 12, 2000, entitled Ergonomic Trigger Sprayer Having Side Saddle Supports, and commonly owned herewith. The entirety of the disclosure of that application is specifically incorporated herein by reference. The trigger sprayer has a pump piston operating in a pump cylinder and reciprocable upon actuation of a trigger lever 7 in a manner known in this art. The sprayer includes a rotatable nozzle cap 38 having a discharge orifice (not shown), and assembly 23 includes an integral gripper handle 39 which, as shown in FIG. 4, may be hollow.

Figures 4, 5, 6, 7, 8:
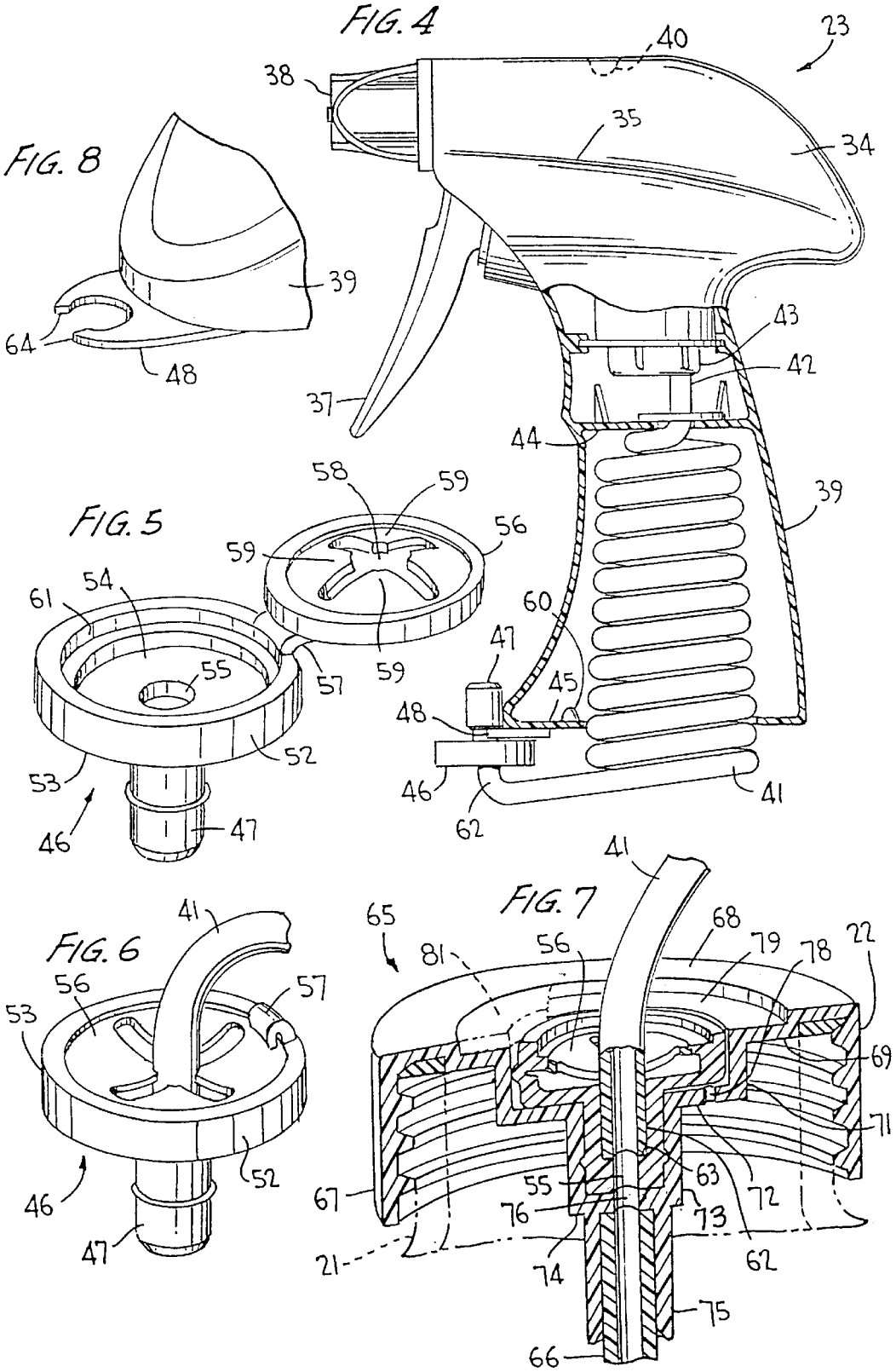
FIG. 4 is a side elevational view, in part section, of the trigger sprayer assembly of FIG. 1.
FIG. 5 is a perspective view of a one-piece adaptor according to the invention for connecting the delivery tube to the container, the adaptor being shown in a non-use position.
FIG. 6 is a view similar to FIG. 4 showing the adaptor connected to the delivery tube in a use position.
FIG. 7 is a vertical sectional view taken through an assembly according to the invention for connecting the fluid delivery tube to a rigid dip tube for a liquid spray dispenser, which includes the adaptor of FIGS. 5, 6.
FIG. 8 is a partial, slightly enlarged view of a portion of the gripper handle of the assembly of FIG. 4 showing a bracket for mounting an end of the delivery tube in place.

Assembly 23 includes an elongated hollow flexible delivery tube 41 which, according to the embodiment of FIGS. 1, 2 and 4, is coiled during storage and shipping within hollow gripper handle 39, although a portion of the coiled tubing extends outwardly of the end of the handle, as shown. One end 42 of tube 41 is connected to an inlet element 43 of the trigger sprayer which includes an inlet passage to the pump chamber (not shown) of known type. The length of handle 39, i.e., the distance between opposing walls 44 and 45 thereof is of such dimension that delivery tube 41 extends slightly outwardly of wall 45 as clearly shown in FIG. 4. Two or three or more turns of the coiled tube extend outwardly of the hollow handle to function as hereinafter described.

The opposite distal end 62 of tube 41 is non-removably connected to an adaptor generally designated 46 in FIGS. 4 to 7. The adaptor has a nipple 47 which snaps into the claws of a bracket 48 fixed to wall 45 of the gripper handle, and extending outwardly of the forward end thereof as shown in FIGS. 4 and 8. The distal end of the tube with the adaptor 46 mounted thereon is therefore removably supported by bracket 48 in a convenient and easily accessible manner in the non-use position of FIG. 4.

Referring to FIGS. 1 to 3, the trigger sprayer assembly 23 is shaped and sized to be complementary in shape to that of walls 28, 29, 31, 32 and 33 of the enlarged opening at the upper section of the container. It is to be noted that opposing walls 29 and 31 include recesses 49, 51 of complementary shape to that of protrusions 35, 36 of the trigger sprayer. The trigger sprayer may thus be securely mounted to the container lying on one or the other of its sides and extending transversely of the container as shown in FIGS. 1 and 2.

Protrusions 35 and 36 of the sprayer are cradled within recesses 49 and 51 as the sprayer is simply snapped into place when inserted into cutout portion 27. As shown wall 33 slopes so as to complement the shape of the sloping side walls of gripper handle 39.

Alternatively, protrusions such as 35 and 36 could be provided on walls 29 and 31 at cutout 27. The side walls of the sprayer would then be provided with recesses such as 49 and 51 which cradle the protrusions. Such an alternative, although not shown, can be provided without departing from the scope of the invention.

The spacing between walls 28 and 32 of the opening at the upper section of the container is such that when the trigger sprayer assembly is mounted to the container on its side and with its nozzle end extending transversely as shown, the outermost turn of the coiled tube bears snugly against wall 32 at the upper end of the container. The coils of the tube are slightly compressed such that the compressed coils together function to resiliently maintain the trigger sprayer assembly in place within the enlarged opening at the upper section of the container. Such a location for the mounted trigger sprayer assembly renders it convenient for the operator to easily access the trigger sprayer without reaching around a side of the container or without having to unsnap mounting means or the like.

To positively prevent the trigger sprayer from shifting during storage and shipment in a direction transverse to the container (direction of double arrow of FIG. 2), transverse wall 28 of cutout 27 may have a pair of protrusions 30 (FIG. 3) which project into recesses 40 provided on the top wall of sprayer assembly 23 (FIG. 2) when the sprayer assembly is mounted in place as shown in FIGS. 2 and 3. Also for this purpose projections 50 may be provided on wall 32 (FIG. 3) for the reception in recesses 60 (FIG. 4) located in the confronting lower wall 45 of the sprayer handle.

Adaptor 46 according to the invention is of one-piece plastic construction having a cylindrical body 52 with a hollow nipple 47 depending therefrom. The body has an outer cylindrical wall 53 and a bottom wall 54 containing a central opening 55 coaxial with the passage extending through hollow nipple 47. The adaptor further includes a conical disc 56 integrally hinged as at 57 to cylindrical wall 53. The disc has a central opening 58 defined by a plurality of tines 59 which as will be seen together function as one-way ratchet teeth.

The adaptor is molded in its condition of non-use of FIG. 5 as a single piece. The inner diameter 61 of cylindrical wall 53 is slightly less than the outer diameter of the conical disc such that during sub-assembly of the trigger sprayer dispensing system of the invention, the conical disc is inserted into cylindrical wall 53 of body 52 such that its central opening 58 lies coaxial with central opening 55, as shown in FIG. 6. A slightly smaller inner diameter 61 assures the snug fit of the conical disc in the FIG. 6 position, maintaining the disc in place. Otherwise retention lugs (not shown) molded to the upper surface of wall 53 and overlying disc 56 can be provided for maintaining the conical disc in place.

After the conical disc is snapped into place within the recess of the cylindrical body 52, distal end 62 of delivery tube 41 is plugged into the adaptor through central openings 58 and 55 until it reaches a stop shoulder 63, as shown in FIG. 7. Any attempt to separate the adaptor from the distal end of the delivery tube is resisted as tines 59 ratchet into the distal end of the tube preventing separation.

In the non-use position of shipping and storage shown in FIG. 4, nipple 47 is simply snapped into the opening presented by jaws 64 of bracket 48 (see FIG. 8) while the underside of cylindrical body 52 underlies the bracket for removably retaining the distal end and its adaptor in place on gripper handle 39 of the trigger sprayer assembly.

FIG. 7 discloses an assembly 65 for connecting delivery tube 41 to a rigid dip tube 66 which extends as in any normal manner into container 21 toward the container bottom wall to form an inlet passage for the liquid from the container to the pump chamber of the trigger sprayer during each suction stroke of the trigger sprayer pump.

Assembly 65 includes closure cap 22 having a circular side wall 67 which may be internally threaded as shown for threaded engagement with the neck finish of the container. Otherwise the closure may be secured to the container neck in any other manner known in this art.

The closure further comprises an upper end wall 68 generally of a three-stepped configuration. Thus the end wall has an annular lower wall section 69 with a first inner circular wall 71 depending therefrom, and an annular base wall 72. The base wall has a second inner circular wall 73 having a lower wall 74 from which a sleeve 75 depends. The sleeve supports rigid dip tube 66 in the known manner, and walls 71, 72, 73 together define a central well for the reception of adaptor 46. When assembled as shown in FIG. 7, nipple 47 is plugged into circular wall 73. Its central opening 55 is coaxial with an opening 76 located in lower wall 74. An external retention bead 77 may be provided on nipple 47 for mating engagement with a corresponding annular groove in end wall 73 for securely retaining the adaptor in place.

Circular body 52 of adaptor 46 is received in the space defined by walls 71 and 72, although the walls of the well are so dimensioned relative to the size of the adaptor that bottom wall 54 of the cylindrical body is spaced slightly from annular wall 72, and cylindrical wall 53 is spaced slightly from circular wall 71. A vent port 78 is located in base wall 72 for establishing a vent passage between the interior of the container and outside the closure via the spacing between walls 54, 72 and between 53, 71. During operation, therefore, as the contents of the circular liquid are discharged during pumping, the container interior is replenished with air via the open vent passage to avoid hydraulic lock and container collapse.

The annular lower wall section 69 of the closure cap defines a circular recess 79 for the reception of a circular shipping seal 81 which in a non-use position covers the well in which the adaptor is received. In other words, during conditions of shipping and storage of the dispensing system shown in FIGS. 1 and 2, the contents of the container are sealed closed against leakage by the provision of seal 81. In preparation for connection of the trigger sprayer assembly to the container the shipping seal 81 is simply removed in any normal manner thereby exposing the well in the closure cap for the reception of the adaptor with its connected delivery tube as in the manner aforedescribed.

Figure 9:
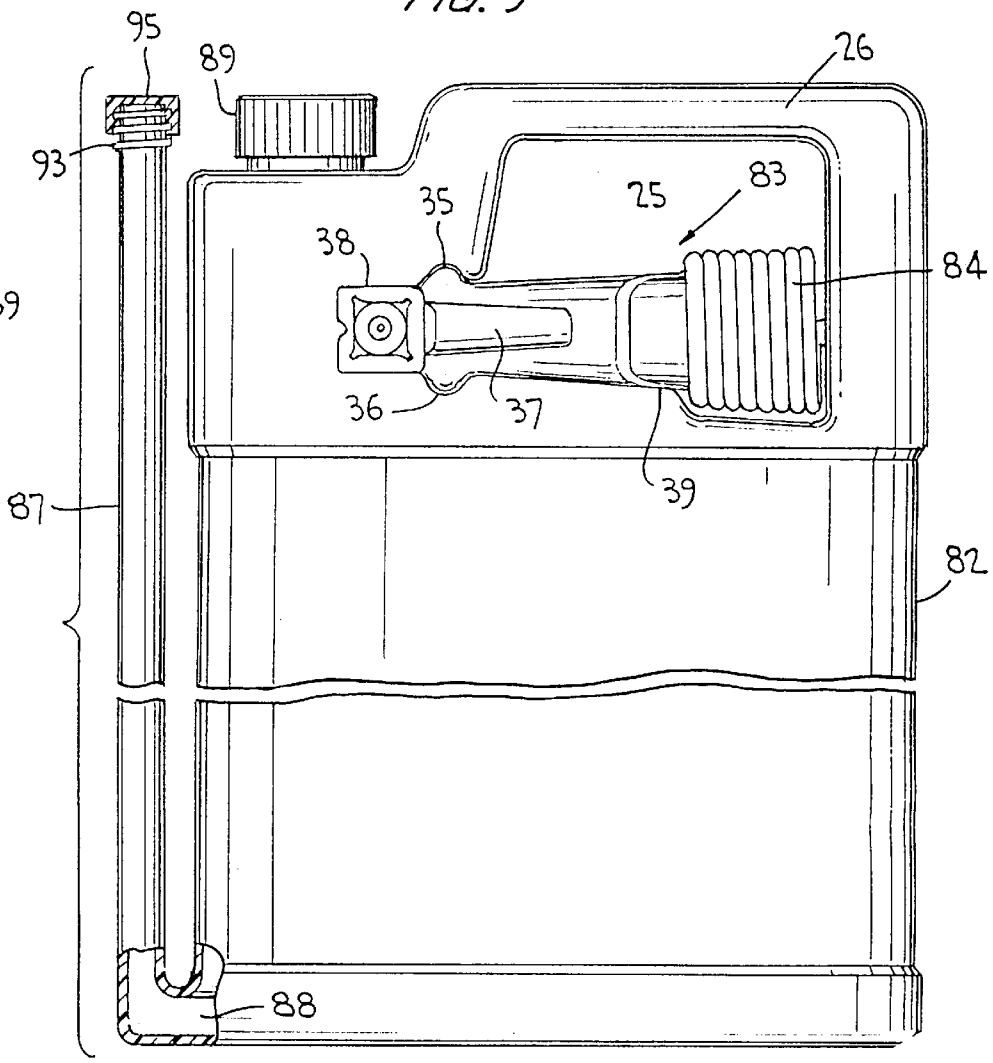
FIG. 9 is a side elevational view of a dispensing assembly according to another embodiment of the invention which includes a container, a trigger sprayer assembly removably mounted thereto and a delivery tube.
Figure 10:
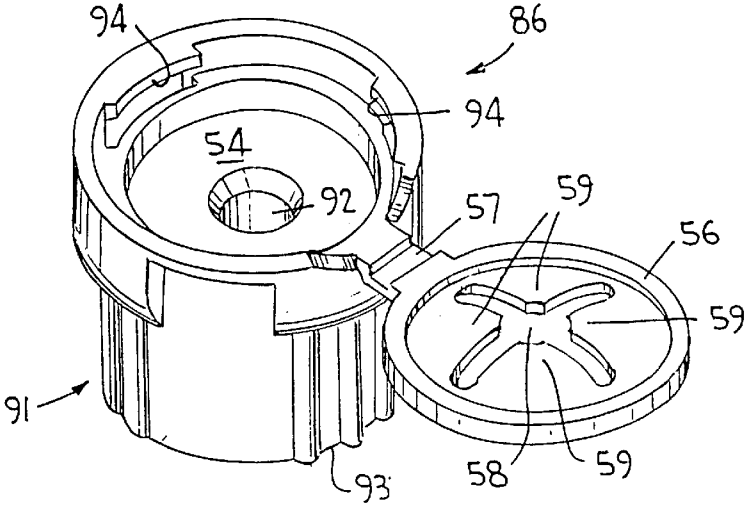
FIG. 10 is a perspective view of an adaptor according to another embodiment of the invention for mounting the delivery tube to the container, the adaptor being shown in a non-use position.
Figure 11:
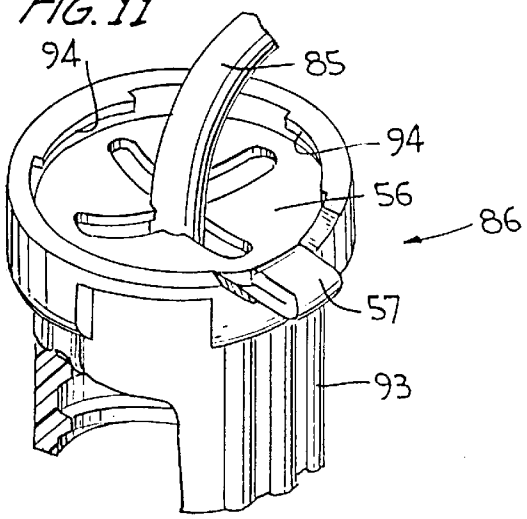
FIG. 11 is a view similar to FIG. 10 of the adaptor shown in a use position non-removably connected to the delivery tube.

Another embodiment of the invention is disclosed in FIGS. 9 to 11. Container 82, which may likewise be of a high density polyethylene, is similar to container 21 of FIGS. 1 and 2. Container 21 likewise has an opening 25 defining a carrying handle 26, the opening being enlarged for the reception of a trigger sprayer assembly 83 which is the same in all respects as trigger sprayer assembly 23 with the exception of delivery tube 84 which is instead coiled about the exterior of gripper handle 39 of the trigger sprayer. Otherwise, assembly 83 is removably mounted to the container as its upper portion is received within complementary cutout portion 27 with the trigger sprayer assembly disposed on one of its sides and facing laterally. One end (not shown) of delivery tube 24 is connected to outlet element 43 of the assembly through a suitable opening in gripper handle 34. And distal end 85 of the delivery tube is connected to an adaptor generally designated 86 in FIGS. 10 and 11.

Container 82 differs from container 21 of FIGS. 1 to 3 in that the container in accordance with the FIG. 9 embodiment has a separate, external integral tube 87 connected at its lower end to the container in communication therewith via a bottom opening 58. Tube 87 terminates at its free open end essentially at the same elevation as the threaded neck of the container on which a standard closure cap 95 is threadedly mounted.

Adaptor 86 has a cylindrical body 91 with a central through opening 92, the body including a cylindrical wall 93 internally threaded for threaded engagement with upper end 93 of tube 87. Such structure contrasts with adaptor 46 which has a nipple 47 which plugs into a central recess or well provided in the upper end of the closure. Otherwise adaptor 86 is essentially the same as adaptor 46 in that conical disc 57 is connected cylindrical body 91 by an integral hinge 57. Adaptor 86 is of molded onepiece piece construction as shown in FIG. 10 in a position in which it is molded. During the sub-assembly operation of the dispensing system according to the invention, conical disc 56 is pivoted about its hinge to overly bottom wall 54 of the adaptor and is pressed in place beneath a plurality of tabs 94 or the like which overly the conical disc, as shown in FIG. 11. In such position, openings 58 and 92 are coaxial. And as in the FIGS. 5, 6 embodiment, distal end 85 of the delivery tube is secured to the adaptor by extending it into aligned openings 58 and 92 so as to be seated securely within the adaptor. The tines which interengage with the delivery tube function as one-way ratchets preventing tube removal.

In the FIG. 9 position of storage and shipping, the adaptor may simply extend into the lower end of the gripper handle of the trigger sprayer. However, unlike that of the FIGS. 1, 2 embodiment, the delivery tube does not function to resilient assist in mounting the trigger sprayer assembly in place on the container. And, it is to be noted that no dip tube is required for the FIG. 9 embodiment, but instead tube 87 comprises a dip tube to which the delivery tube is connected via adaptor 86. During conditions of non-use, the top of tube 87 is closed by a suitable closure cap 95.

From the foregoing it can be seen that a simple and economical, yet highly effective dispensing system has been devised for a remote pump sprayer comprising a trigger sprayer adapted with a gripper handle and being removably mounted to the container at a convenient and unique location. The trigger sprayer assembly is literally at the fingertips of the operator while carrying the container and is therefore easily and readily accessible for quick removal from its mounted position on the container. Trigger sprayer protrusions (or recesses) are cradled in complementary recesses at the through opening at the top open portion of the container. In one embodiment, the flexible delivery tube itself functions to resiliently assist in mounting the trigger sprayer assembly in place. The opening at the upper section of the container is simply enlarged to make provision for the mounting of the trigger sprayer assembly, thereby avoiding the need for any special type of mounting means or recesses in the side walls or other portions of the container as in the prior art.

The adaptor which is non-removably connected to the distal end of the delivery tube, is of molded one-piece construction which simplifies both the production of the part and renders the single part easier to sub-assemble thereby reducing cost of materials and labor. The adaptor according to one embodiment is plugged into the central recess of a container closure which provides for an assembly for connecting the rigid dip tube with the flexible delivery tube. The structure and arrangement of the connecting assembly is simplified for reducing the time and effort required for subassembly assembly thereby minimizing costs. Moreover, the connecting assembly is provided with a unique and convenient container vent which during use prevents hydraulic lock of the pump and collapse of the container.

The adaptor may otherwise be internally threaded for connecting the distal end of the delivery tube to an integral, external dip tube providing on the container, thereby avoiding the need for a dip tube normally suspended from the closure and projecting into the container.

Other modifications and variations of the present invention are made possible in the light of the above teachings. It is therefore to be understood that within the scope of the appended claims, the invention may be practiced otherwise than as specifically described.

What is claimed is:

1. An assembly for connecting a flexible hollow fluid delivery tube to a rigid dip tube for a liquid sprayer, comprising a container closure having a cylindrical side wall which includes means for engaging a neck of the container, the closure having an upper end wall of stepped configuration comprising a first inner annular wall depending from said end wall, a second inner annular wall of a reduced diameter compared to that of said first wall, an annular base wall interconnecting said first and second inner walls, said second wall having a bottom wall with a central opening, and a depending sleeve on said bottom wall for suspending the dip tube, the first, second and base walls defining a stepped well for the reception of a flexible tube adaptor.

2. The closure according to claim 1, wherein an upper surface of said end wall is recessed radially outwardly of said first inner wall for the reception of a shipping seal which closes said well in a non-use position.

3. The closure according to claim 1, wherein said adaptor has a hollow nipple in engagement with said second inner wall, said nipple having a central aperture coaxial with said central opening of said bottom wall, and said adaptor having a base with an upstanding wall parallel to said base wall and said first annular wall of said closure.

4. The closure according to claim 3, wherein said base wall of said closure has a vent port, said base and said upstanding wall of said adaptor being spaced from said base wall and said first annular wall of said closure to establish a vent path with said vent port between opposite sides of the closure.

* * * * *